US012674312B2

(12) United States Patent
Aumuller et al.

(10) Patent No.: US 12,674,312 B2
(45) Date of Patent: Jul. 7, 2026

(54) METHOD FOR CONSTRUCTING PARKING STRUCTURES

(71) Applicant: Newton Group Ltd., Guelph (CA)

(72) Inventors: Paul M. Aumuller, Guelph (CA); Edwin Newton, Guelph (CA)

(73) Assignee: NEWTON GROUP LTD., Guelph (CA)

( * ) Notice: Subject to any disclaimer, the term of this patent is extended or adjusted under 35 U.S.C. 154(b) by 277 days.

(21) Appl. No.: 18/128,686

(22) Filed: Mar. 30, 2023

(65) Prior Publication Data

US 2023/0313521 A1 Oct. 5, 2023

Related U.S. Application Data

(60) Provisional application No. 63/325,306, filed on Mar. 30, 2022.

(51) Int. Cl.
*E04B 1/24* (2006.01)

(52) U.S. Cl.
CPC ..... *E04B 1/24* (2013.01); *E04B 2001/2481* (2013.01); *E04B 2001/2484* (2013.01)

(58) Field of Classification Search
CPC .... E04H 6/00; E04H 6/08; E04H 6/10; E04B 1/24; E04B 2001/2481; E04B 5/16; E04B 1/04; E04C 3/29; E04C 2/38
USPC ..... 52/745.13
See application file for complete search history.

(56) References Cited

U.S. PATENT DOCUMENTS 2,825,938 A * 3/1958 Ferreira ..... E04H 6/10 52/175
4,972,537 A * 11/1990 Slaw, Sr. ..... E04B 5/04 14/77.1
5,720,135 A * 2/1998 Paquette ..... E04H 6/10 52/263
5,906,076 A * 5/1999 Mc Manus ..... E04G 11/48 52/354
6,658,810 B2 * 12/2003 DeLoach, Sr. ..... B28B 23/024 52/745.11
8,434,277 B2 * 5/2013 Paolucci ..... E04H 6/10 52/177
8,613,172 B2 * 12/2013 Olson ..... E04B 5/10 52/223.6
11,530,547 B2 * 12/2022 McUtchen ..... E04H 6/10
2002/0073637 A1 * 6/2002 Stewart ..... E04H 1/04 52/174
2003/0182883 A1 * 10/2003 Won ..... E01D 6/00 52/223.6
2005/0140038 A1 * 6/2005 Frienser ..... C08G 18/3206 264/45.3

(Continued)

OTHER PUBLICATIONS

DKTEC—Introduction to the storage method of aggregate in concrete batching plant (Year: 2022).*

*Primary Examiner* — Paola Agudelo

(57) ABSTRACT

The method is for constructing parking structures, each parking structure having a site and being of the type including a plurality of parking decks, each deck being defined by a plurality of steel beams supporting a plurality of cementitious panels. The method is of the type wherein each panel is manufactured by pouring concrete into a form remote from the site. The improvement comprises: transporting a plurality of forms to premises proximal to the site; and constructing the panels.

10 Claims, 8 Drawing Sheets

(56) References Cited

U.S. PATENT DOCUMENTS

| | | | | |
|---|---|---|---|---|
| 2008/0313991 | A1* | 12/2008 | Chouinard | E04C 2/06 52/506.01 |
| 2009/0165408 | A1* | 7/2009 | Pask | E04B 1/04 52/745.13 |
| 2011/0131905 | A1* | 6/2011 | Aumuller | B28B 13/026 52/630 |
| 2013/0074430 | A1* | 3/2013 | Morcous | E04B 5/265 52/252 |
| 2014/0260034 | A1* | 9/2014 | Ciuperca | E04C 2/26 52/405.3 |
| 2016/0208486 | A1* | 7/2016 | Rubel | E04B 2/7457 |
| 2022/0243406 | A1* | 8/2022 | Terstriep | E04G 21/10 |
| 2023/0158710 | A1* | 5/2023 | Sostaric | B28C 7/024 366/2 |

* cited by examiner

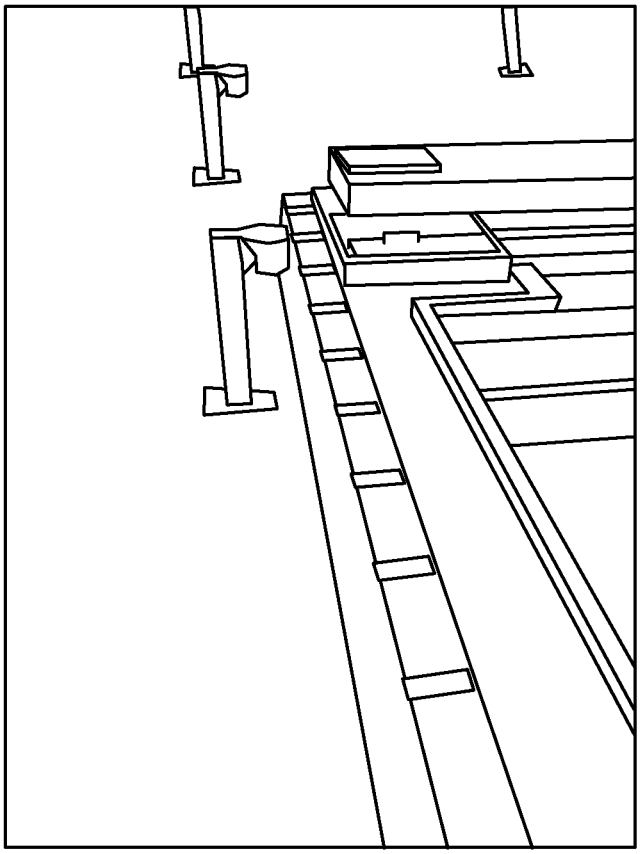
FIG. 2
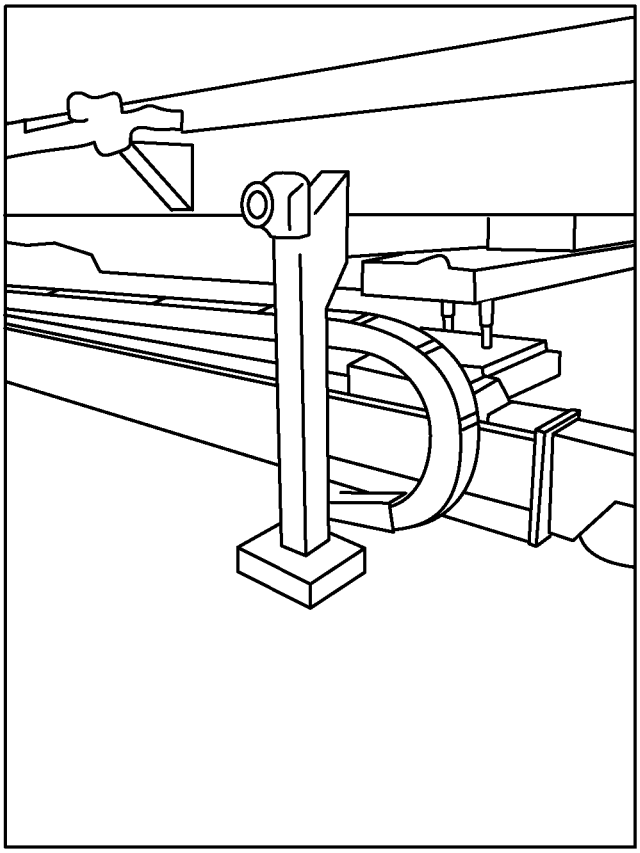
FIG. 2.1

METHOD FOR CONSTRUCTING PARKING STRUCTURES

FIELD OF THE INVENTION

The invention relates to the construction of parking structures.

BACKGROUND

A method for producing parking structures is taught in U.S. Ser. No. 12/870,240.

SUMMARY OF THE INVENTION

Forming an aspect of the invention is an improved method for constructing parking structures.

Each structure has a site and is of the type including a plurality of parking decks, each deck being defined by a plurality of steel beams supporting a plurality of cementitious panels.

In the method, each panel is manufactured by pouring concrete into a form remote from the site.

The improvement comprises: transporting a plurality of forms to premises proximal to the site; and constructing the panels.

According to another aspect, the concrete can be: mixed remote from the premises and shipped to the premises in a ready-mix truck; or shipped to the premises in a mixer truck.

According to another aspect, the concrete can be delivered to a crane-supported bucket at the premises and delivered thereby to the form.

According to another aspect, the concrete poured into a form can be hardened to form a green panel and the green panel can be transformed by subsequent curing into a panel.

According to another aspect, curing of green panels can be carried out externally of the forms.

According to another aspect, removal of a green panel from a form can involve tilting the form and the green panel 90° by a tilt table.

According to another aspect, the panels can be cured at the premises in a comb.

According to another aspect, the green panel, once tilted by the tilt table, can be moved by a crane to the comb.

According to another aspect, the comb can be transported to the premises.

According to another aspect, the tilt table can be transported to the premises.

According to another aspect, parking structures can be completed in seriatim and, once the panels of a structure in the series have been completed, the forms and tilt table are transported to the next structure in the series to be completed.

According to another aspect, the granular material used for the concrete can be stored in a silo, the silo being enrobed in an electrical blanket, to provide for flowability of the granular material in cold conditions.

According to another aspect, the water used for the concrete mixture can be heated in cold conditions.

Advantages, features and characteristics of the present invention will become apparent upon a review of the following detailed description with reference to the accompanying drawings, the latter being briefly described hereinafter.

BRIEF DESCRIPTION OF THE DRAWINGS

In the Appended Drawings:

FIG. 2 is a view of a prior art thumper cart;

FIG. 2.1 is a view of the mold table on top of the thumper cart;

DETAILED DESCRIPTION OF AN EMBODIMENT OF THE IMPROVED METHOD

In the example embodiment, the parking structures and the method for construction are of the type described in U.S. Ser. No. 12/870,240, incorporated herein by reference. By way of background, the prior art involves structures, a facility and a method.

The structures are each of the type having: a site; one or more parking decks, each deck being defined by a plurality of horizontal cementitious panels; for and supporting each of said one or more parking decks, a plurality of horizontal steel beams; and columns supporting the beams.

Figure 1:
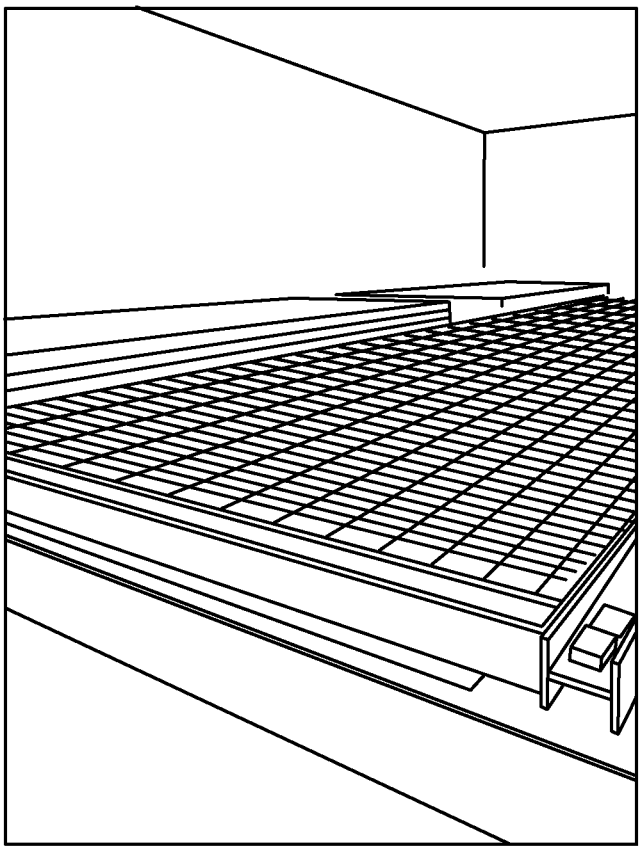
FIG. 1 is a view of a prior art mold table.

The facility has: a plurality of molds [FIG. 1]; a mixer for producing a supply of fluid concrete; a rail-mounted concrete dispenser/finisher in the form of a gantry adapted to, in use, receive said supply of fluid concrete from the mixer and deliver same to a mold, the gantry including dual vibrating screeds which move between raised and lowered positions, the gantry, in use: (i) filling the mold with said supply of fluid concrete, finishing the concrete in a first pass over the mold with the screeds in the lowered positions; and returns towards the mixer in a second pass over the mold with the screeds in the raised positions; a staging area, in which molds are placed before filling; thumper cart [FIG. 2], upon which the table is loaded [FIG. 2.1] which transports mold tables by rail from the staging area to the molding area for filling and, after the gantry has made its first pass, vibrates the mold to remove voids from the fluid concrete contained therewithin.

The method involves: producing the panels at the facility; installing the columns at the site; fixing cambered beams to the columns and jacking the ends of the beams; moving the panels to the site and placing them upon the cambered beams; grouting the interstices between the panels; and removing the jacks to allow gravity to remove the camber from the beams and the place the grout and the upper surfaces of the panels into compression.

Persons of ordinary skill will readily appreciate that the teachings of U.S. Ser. No. 12/870,240 represented a significant advantage over typical cast in place parking garages. By using principles of modular construction for the garage, and assembly line type manufacture for the modules, garages of relatively low cost and relatively high quality can be constructed within a relatively large area surrounding the manufacturing facility for the panels, basically, that area to which massive cementitious elements can be transported without undue cost. [The beams and columns will typically also be constructed at the facility, but, being substantially lighter, are relatively easily transported; where suitable heavy steel fabrication facilities existed near the construction site, that option would of course be employed.]

The improved method differs from the prior art method in several ways.

Tilt Table and Comb Used in Panel Production

Figure 3:
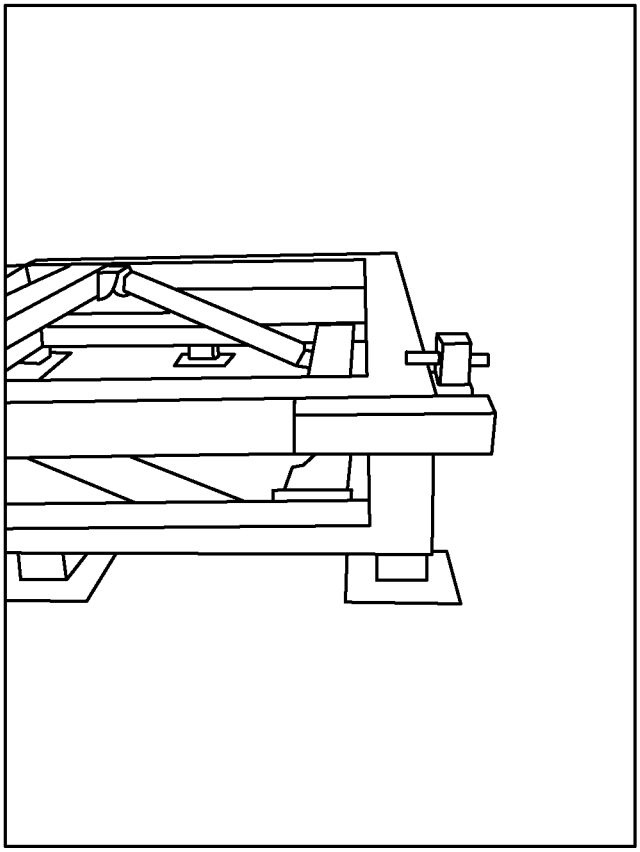
FIG. 3 is a view of a tilt table in a horizontal position.
Figure 4:
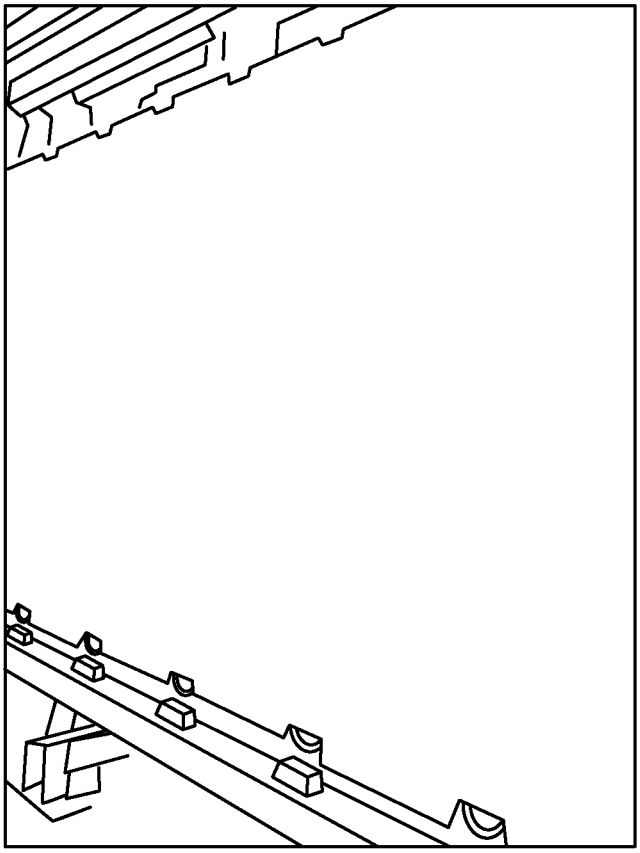
FIG. 4 is a view of the tilt table of FIG. 3 loaded with a mold and panel.
Figure 5:
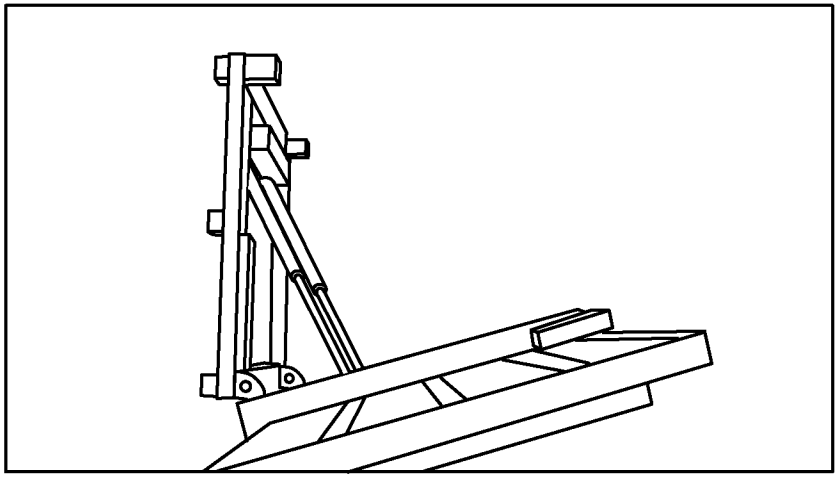
FIG. 5 is a view of tilt table with an extender in a vertical position, the extender being in receipt of a panel.

Tilt table [FIG. 3] is adapted to receive a mold table and a panel contained therein and to tilt the mold table and contained panel between a horizontal molding [FIG. 4] position and a vertical release position [FIG. 5].

Figure 6:
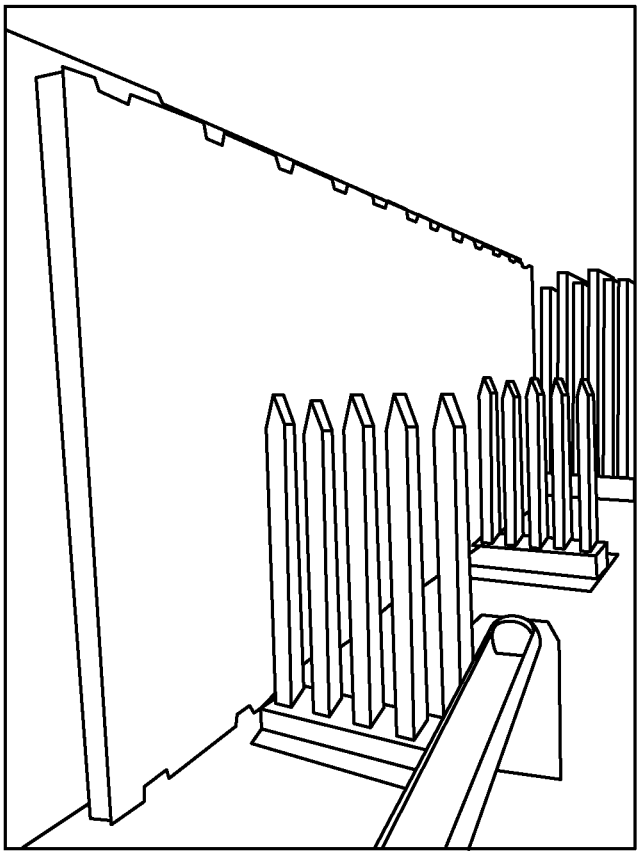
FIG. 6 is a view of the comb in receipt of a panel.
Figure 7:
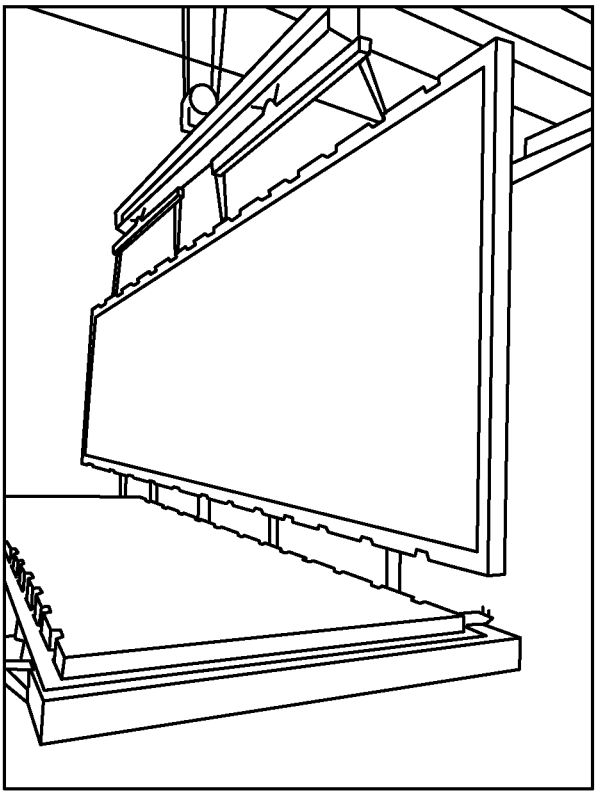
FIG. 7 is a view of a panel being lifted from a comb.

Comb is adapted to support a panel in a vertical position [FIG. 6].

Panel production involves: pouring concrete into a mold table; allow the concrete to harden to form a green panel; tilting the table and the green panel 90° with the tilt table; moving the green panel to the comb with a crane; curing the green panel in the comb to form a panel. When the panel is ready for installation, an extender is added to the tilt table; the panel is lifted by the crane from the comb, placed upon the upright table/extender and pivoted, along with the tilt table, to a horizontal position, to permit subsequent movement in the horizontal position by the crane or another steel carrier to a flatbed for shipment to the site.

No On-Premises Concrete Mixer and Aggregate Storage

Figure 8:
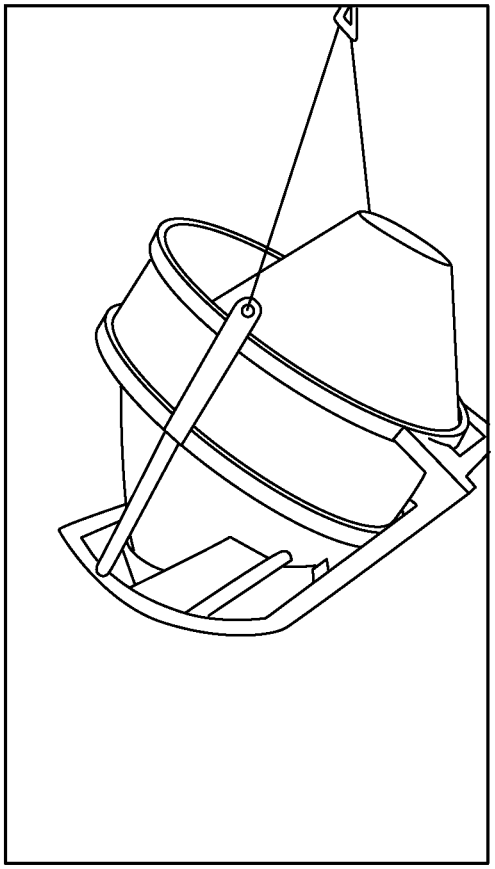
FIG. 8 is a view of a crane-supported bucket.
Figure 9:
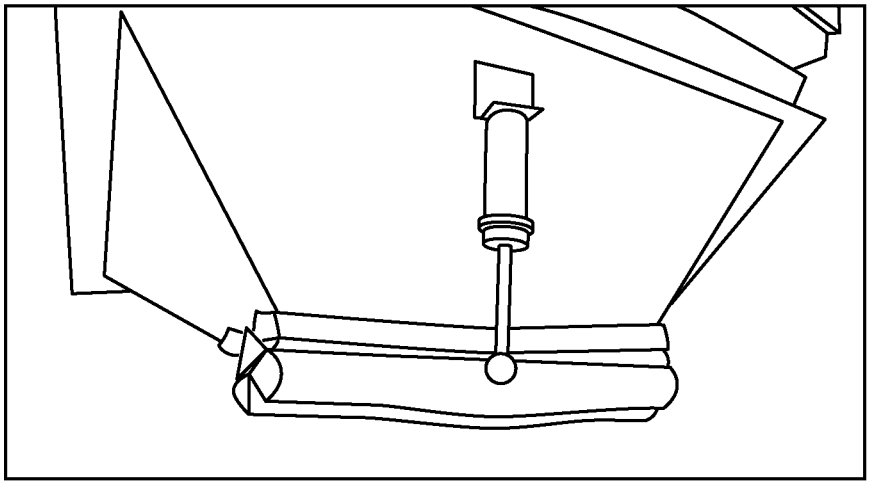
FIG. 9 is a view of a prior art bin
Figure 10:
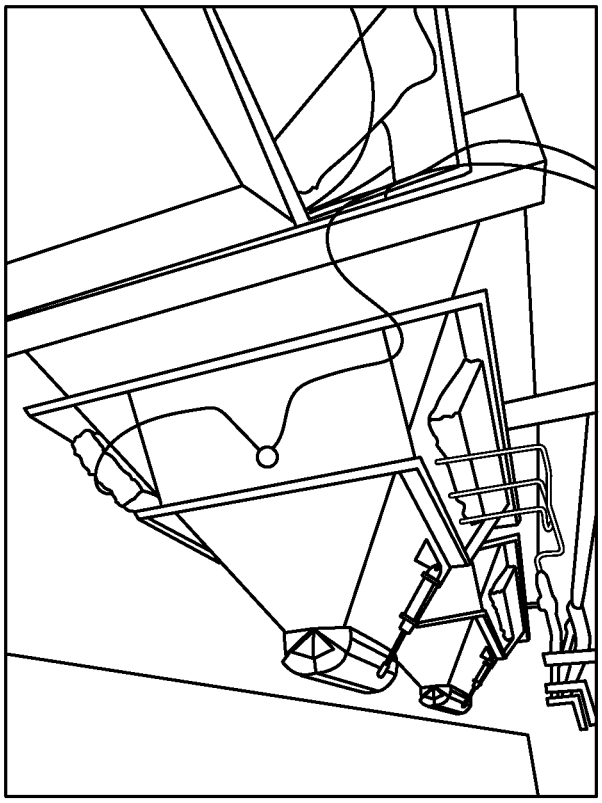
FIG. 10 is a view of a blanket on the bin.
Figure 11A:
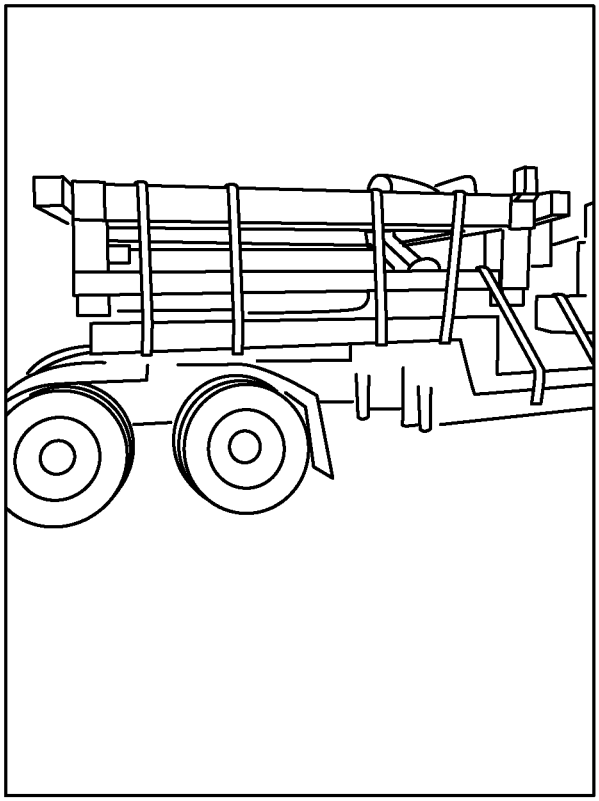
FIG. 11 is a view showing the equipment loaded for transport.
Figure 11B:
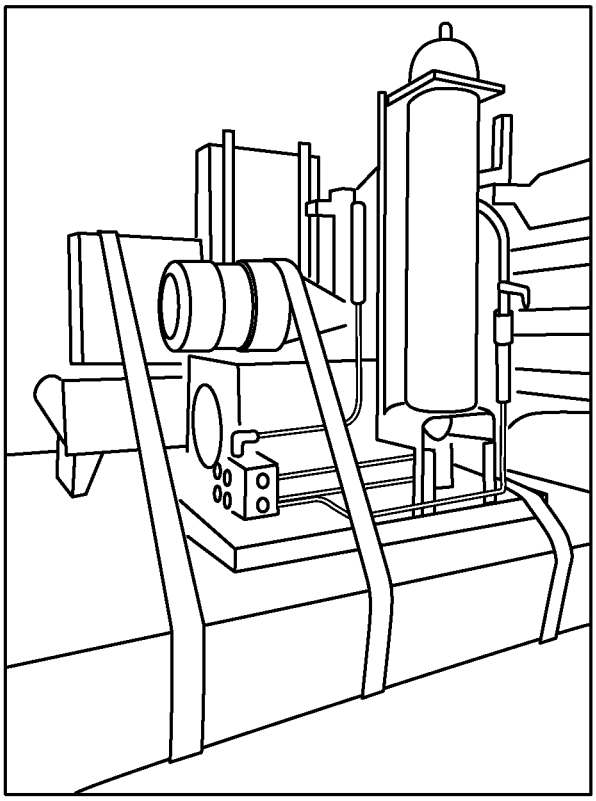
Figure 11C:
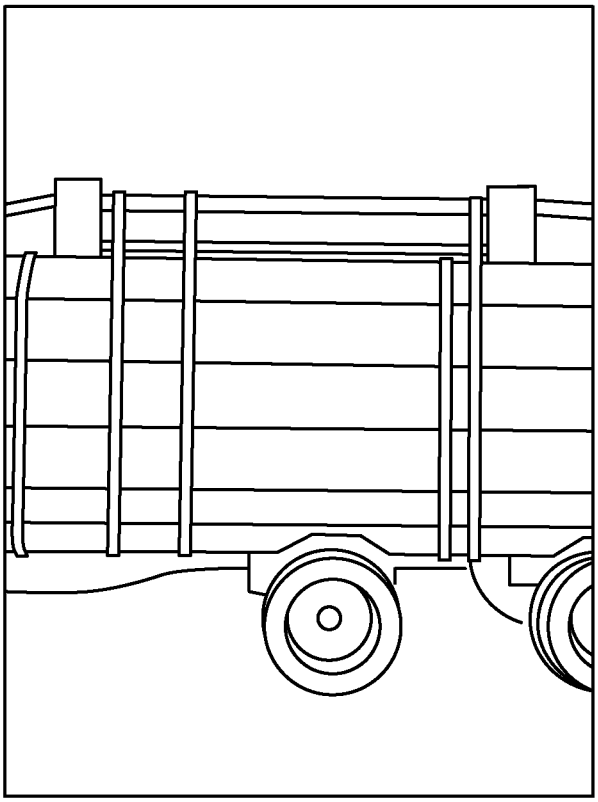
Figure 11D:
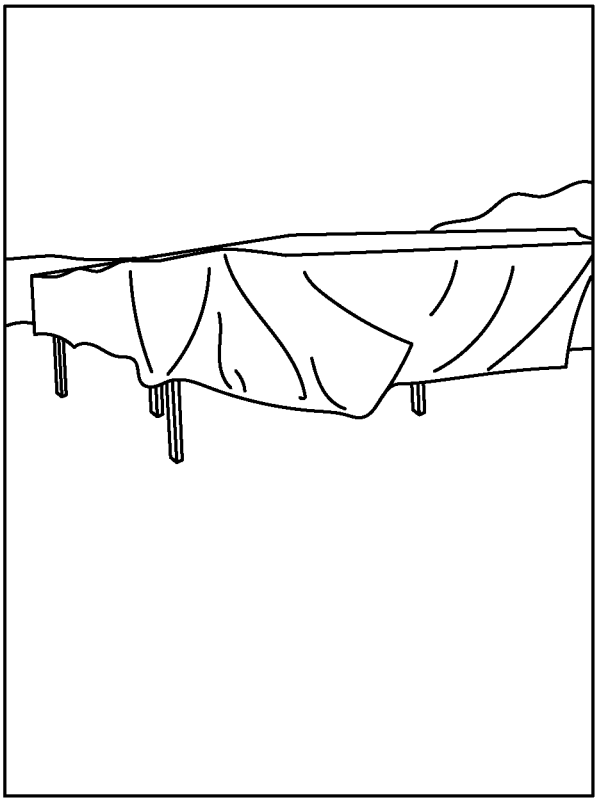

In the improved method, the concrete is: mixed remote from the premises and shipped to the premises in a ready-mix truck; or shipped to the premises in a mixer truck; and delivered to a crane-supported bucket [FIG. 8] at the premises and delivered thereby to the form. In cold weather, the silo that houses the aggregate [FIG. 9] is sheathed with an electrical blanket [FIG. 10] to improve flowability of the granular material and to increase the mix temperature; also to improve mix temperature, hot water is used for the mix.

Temporary Premises

In the present method, the molds, tilt table, extender, thumper table, comb are transported [FIG. 11] to premises near the construction site, as is the electrical blanket, if necessary. Once the panels of a garage in the series have been completed, the equipment is transported to the next garage in the series to be completed, or back to the fixed facility.

The invention claimed is:

1. An improved method for constructing parking structures, each parking structure having a site and being of the type including a plurality of parking decks, each deck being defined by a plurality of steel beams supporting a plurality of cementitious panels, the method being of the type wherein each panel is manufactured by pouring concrete into a form at a premises proximal to the site, the improvement comprising:

transporting a plurality of the forms to the premises;

receiving, at the premises, concrete that has been mixed remote from the premises; and constructing the panels, wherein constructing the panels comprises, for each panel:

pouring the concrete into a respective one of the forms at the premises, the concrete hardening in the respective form to provide a green panel;

removing the green panel from the respective form, comprising tilting the respective form and the green panel by a tilt table to a vertical position; and placing the green panel, removed from the respective form, in a vertical position in a comb that supports multiple green panels and curing the green panel in the comb at the premises to provide a cured panel.

2. The method according to claim 1, wherein the concrete is:

shipped to the premises in a ready-mix truck; or shipped to the premises in a mixer truck.

3. The method according to claim 1, wherein the concrete is delivered to a crane-supported bucket at the premises and delivered thereby to the respective form.

4. The method of claim 1, wherein removing the green panel from the respective form involves tilting the respective form and the green panel 90' to the vertical position by the tilt table.

5. The method according to claim 1, wherein the green panel, once tilted by the tilt table, is moved by a crane to the comb.

6. The method according to claim 5, wherein the comb has been transported to the premises.

7. The method of claim 5, wherein the tilt table has been transported to the premises.

8. The method of claim 7, wherein the parking garages are completed in seriatim and, once the panels of a garage in the series have been completed, the forms and tilt table are transported to a further premises proximate a site of the next garage in the series to be completed.

9. The method of claim 1, wherein a granular material used for the concrete is stored in a silo, the silo being enrobed in an electrical blanket, to provide for flowability of the granular material in cold conditions.

10. The method of claim 1, wherein the water used for the concrete is heated in cold conditions.

* * * * *